US011931665B2

(12) United States Patent
Osculati

(10) Patent No.: US 11,931,665 B2
(45) Date of Patent: Mar. 19, 2024

(54) TOY SYSTEM AND TOY FIGURE HEAD AND HEADWEAR

(71) Applicant: LEGO, Billund (DK)

(72) Inventor: Stefano Osculati, Billund (DK)

(73) Assignee: LEGO A/S, Billund (DK)

( * ) Notice: Subject to any disclaimer, the term of this patent is extended or adjusted under 35 U.S.C. 154(b) by 361 days.

(21) Appl. No.: 17/426,248

(22) PCT Filed: Jan. 29, 2020

(86) PCT No.: PCT/EP2020/052095
§ 371 (c)(1),
(2) Date: Jul. 28, 2021

(87) PCT Pub. No.: WO2020/157095
PCT Pub. Date: Aug. 6, 2020

(65) Prior Publication Data

US 2022/0280880 A1 Sep. 8, 2022

(30) Foreign Application Priority Data

Jan. 29, 2019 (DK) ..... PA201970062

(51) Int. Cl.
*A63H 3/16* (2006.01)
*A63H 3/44* (2006.01)
*A63H 3/52* (2022.01)

(52) U.S. Cl.
CPC ..... *A63H 3/16* (2013.01); *A63H 3/44* (2013.01); *A63H 3/52* (2013.01)

(58) Field of Classification Search
CPC ... A63H 3/16; A63H 3/44; A63H 3/52; A63H 3/365

(Continued)

(56) References Cited

U.S. PATENT DOCUMENTS 2,327,059 A * 8/1943 George ..... G03B 15/08 446/337
3,583,059 A * 6/1971 Ceolin ..... A63H 3/16 29/444

(Continued)

FOREIGN PATENT DOCUMENTS

AR 211357 A1 11/1977
CN 201370962 Y 12/2009

(Continued)

OTHER PUBLICATIONS

First Technical Examination Report from priority Danish application No. PA 201970062, dated Jul. 10, 2019, 9 pages.

(Continued)

*Primary Examiner* — Joseph B Baldori
(74) *Attorney, Agent, or Firm* — Day Pitney LLP; Anthony A. Kassas

(57) ABSTRACT

A toy figure system having
a toy figure head, and
a top headwear item
wherein the toy figure head includes a first central coupling member, the first coupling member having a tubular wall with an internal space;
wherein the top headwear item includes a second central coupling member configured for cooperating with said internal space of the first coupling member; and
wherein the toy figure system includes an intermediate headwear item, comprising a connector ring configured for coupling to an outer surface of said first coupling member.

13 Claims, 4 Drawing Sheets

(58) Field of Classification Search
USPC ..... 446/97, 99, 100, 321
See application file for complete search history.

(56) References Cited

U.S. PATENT DOCUMENTS

| | | | | | |
|---|---|---|---|---|---|
| 4,030,239 | A * | 6/1977 | White | A63H 3/48 | 446/353 |
| 4,185,412 | A * | 1/1980 | Rahmstorf | A63H 3/16 | 446/98 |
| 4,356,659 | A * | 11/1982 | Clarke | A63H 3/40 | 446/97 |
| 4,399,632 | A * | 8/1983 | Iseki | A63H 3/16 | 446/101 |
| 4,643,691 | A * | 2/1987 | Keiji | A63H 3/46 | 446/376 |
| 4,820,234 | A * | 4/1989 | Isaf | A63H 3/16 | 446/337 |
| 6,146,721 | A * | 11/2000 | Freynet | A63H 3/365 | 446/236 |
| 6,447,359 | B1 * | 9/2002 | Crump | A63H 3/44 | 446/337 |
| 6,511,359 | B1 * | 1/2003 | Lui | A63H 3/16 | 40/411 |
| 6,568,986 | B2 * | 5/2003 | Kobayashi | A63H 3/46 | 446/268 |
| 8,210,891 | B2 * | 7/2012 | Brumagin | A63H 3/46 | 446/376 |
| 9,573,075 | B1 * | 2/2017 | Capriola | A63H 33/042 | |
| 10,220,325 | B1 * | 3/2019 | Kelley | A63H 17/25 | |
| 10,421,025 | B1 * | 9/2019 | Ward | A63H 3/365 | |
| 11,305,204 | B1 * | 4/2022 | Nam | A63H 3/16 | |
| 2013/0023183 | A1 * | 1/2013 | Zheng | A63H 3/44 | 446/394 |

FOREIGN PATENT DOCUMENTS

| | | | |
|---|---|---|---|
| CN | 102921174 | A | 2/2013 |
| CN | 108176056 | A | 6/2022 |
| DE | 3143496 | A1 | 6/1983 |
| FR | 2340112 | A1 | 9/1977 |
| FR | 2418001 | A1 | 9/1979 |
| JP | 85480394 | U | 1/1979 |
| JP | 856173382 | U | 12/1981 |
| JP | 861133092 | U | 8/1986 |
| JP | H0235795 | U | 3/1990 |

OTHER PUBLICATIONS

International Search Report and Written Opinion from corresponding international application No. PCT/EP2020/052092, dated Apr. 1, 2020, 10 pages.

First Office Action issued in corresponding Chinese Patent Application No. 202080010904.6, dated Apr. 26, 2022, 6 pages.

* cited by examiner

TOY SYSTEM AND TOY FIGURE HEAD AND HEADWEAR

CROSS-REFERENCE TO RELATED APPLICATIONS

This application is a U.S. National Stage of International Application No. PCT/EP2020/052095, filed on 29 Jan. 2020 and published on 6 Aug. 2020, as WO2020/157095, which claims the benefit of priority to Danish Patent Application No. PA 2019 70062, filed on 29 Jan. 2019. The content of each of the above referenced patent applications is incorporated herein by reference in its entirety for any purpose whatsoever.

FIELD OF THE DISCLOSURE

The present disclosure relates to a toy system comprising a toy figure, a toy figure head, top headwear, and intermediary headwear. The disclosure also relates to a toy figure head, as well as to an intermediate headwear for a toy figure head. More particularly the present disclosure relates to toy figures that are formed from rigid parts, formed in a herd material, for example injection molded materials, such as plastic.

BACKGROUND

In the field of toy figures and toy systems comprising toy figures, it is known to have a modular toy system, where a toy figure body may be provided with a releasably mounted toy head, which allows the toy figure body to be equipped with interchangeable heads, for example heads having different facial expressions or other characteristics, such as gender characteristics, etc. Also, known in the art is toy systems, where a toy figure head may be shaped so that it can be interchangeably be mounted with various different types of top headwear items, such as hair-type top headwear items or hat-type top headwear items. An example of such a system is shown in FIG. 1 of the attached drawing. A disadvantage of this system is that it is not possible to attach additional headwear items, such as items resembling glasses, or different items such as hair and a hat to the toy figure head, without integrating them into the top headwear item.

U.S. Pat. No. 4,185,412 discloses a toy figure with a head construction with a head part, a wig part and a hat part. The wig part can be mounted in a hole (socket) in the head part, and the hat part has a downwardly extending socket pin that can be mounted in a corresponding notch in the wig part. While this system allows to combine the head part with various types of wig parts and various hat-parts, it is unsuitable for providing the head part with various face covering parts such glasses, scuba-masks or other masks.

JP patent document no. 56173382 discloses a toy figure with a head construction comprising a head part, a wig part and a hat part. The wig part can be mounted onto a peg on the hat part, and the peg on the hat part can be inserted into a socket in the head part, so that the wig part is locked between the peg and the socket. While this system allows to combine the head part with various types of wig parts and various hat-parts, it is unsuitable for providing the head part with various face covering parts such glasses, scuba-masks or other masks.

The Japanese utility model JP56173382U discloses a toy figure, having a head part and a hair resembling wig part. The wig part has a downwardly extending protrusion attachable in a boss upwardly extending in the head part. A further part, resembling pigtails of hair is provided between the wig part and the head part, such that the wig part and the further appears as a hair style with pigtails. The pigtail part has an annular holding portion to surround a thin diameter portion of the protrusion from the wig part, and such that the annular holding portion is held sandwiched between a thick portion of the protrusion and an upper surface of the boss. In an inner surface of the wig part a vertically oriented elongate notch is formed to allow room for connecting member of the pigtail part to extend downwards from the upper edge of the head part to the lower edge of the wig part. The head part, the wig part and the pigtail part, once assembled is coherent unit.

Thus, there is a need for a toy system, where the options for mounting different headwear items is increased.

SUMMARY OF THE DISCLOSURE

In a first aspect of the disclosure the above mentioned object, as well as other objects, is achieved by toy figure system comprising

- a toy figure head, and
- a top headwear item,
- wherein the toy figure head comprises a first central coupling member, the first coupling member comprising a tubular wall with an internal space, and an outer surface;
- wherein the top headwear item comprises second central coupling member configured for cooperating with said internal space of the first coupling member; and
- wherein the toy figure system comprises an intermediate headwear item, comprising a connector ring configured for coupling to or encircling the outer surface of said first coupling member.

Thereby the connector ring on the wig part may be designed much more rigid so that it can support more rigid parts such as glasses or scuba-masks or other heavier equipment. Furthermore it enables that the hat part can be securely assembled onto the head part with or without the use of a wig part.

In an embodiment, the second central coupling member comprises a second snap member, and the first central coupling member comprises a complementary first snap member. In such embodiments, the toy figure head may be coupled to a toy figure body via coupling means provided at a bottom surface of the toy figure head.

Alternatively, the toy figure system further comprises a toy figure with a toy figure body, and the second central coupling member comprises a second snap member and a complementary first snap member is formed within said toy figure body.

In any of the previous embodiments the first coupling member may comprise a bead formed along an upper rim of the tubular wall. This allows an intermediate headwear item to be connected to the first coupling member in a snap fit connection.

In any of the previous embodiments the intermediate headwear item may comprise a back portion having an upwardly facing surface and a downwardly facing surface, where the downwardly facing surface is configured for abutment with a rim of the toy figure head.

Further, in any of the previous embodiments the toy figure head may comprise a front face, a back scull portion and two side surfaces interconnecting the front face and the back scull portion, wherein the front face comprises a front face rim, wherein the back scull portion comprises a back scull rim, and wherein the back scull rim is formed lower than the front face rim. A lower back skull rim allows room for an intermediate headwear item.

In a second aspect of the disclosure, the above mentioned object and other objects of the disclosure may be obtained by a toy figure head for mounting/receiving a top headwear item and an intermediate headwear item, the toy figure head comprising a front face, a back scull portion, two side surfaces interconnecting the front face and the back scull portion, and a first central coupling member, wherein the first central coupling member comprises a tubular wall with an internal space, wherein the front face comprises a front face rim, wherein the back scull portion comprises a back scull rim, and wherein the back scull rim is formed lower than the front face rim.

In an embodiment, the first coupling member comprises a bead formed along an upper rim of the tubular wall.

In a third aspect of the disclosure, the above mentioned object and other objects of the disclosure may be obtained by an intermediate headwear item for mounting on a toy figure head, wherein the intermediate headwear item comprises a connector ring configured for coupling to an outer surface of a first coupling member of a toy figure head.

In a fourth aspect of the disclosure, the above mentioned object and other objects of the disclosure may be obtained by a use of an intermediate headwear item according to the third aspect of the disclosure for mounting on a toy figure head according to the second aspect of the disclosure.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the disclosure will be described in greater detail with reference to embodiments shown by the enclosed figures. It should be emphasized that the embodiments shown are used for example purposes only and should not be used to limit the scope of the disclosure.

DETAILED DESCRIPTION OF THE EMBODIMENTS

Figure 1:
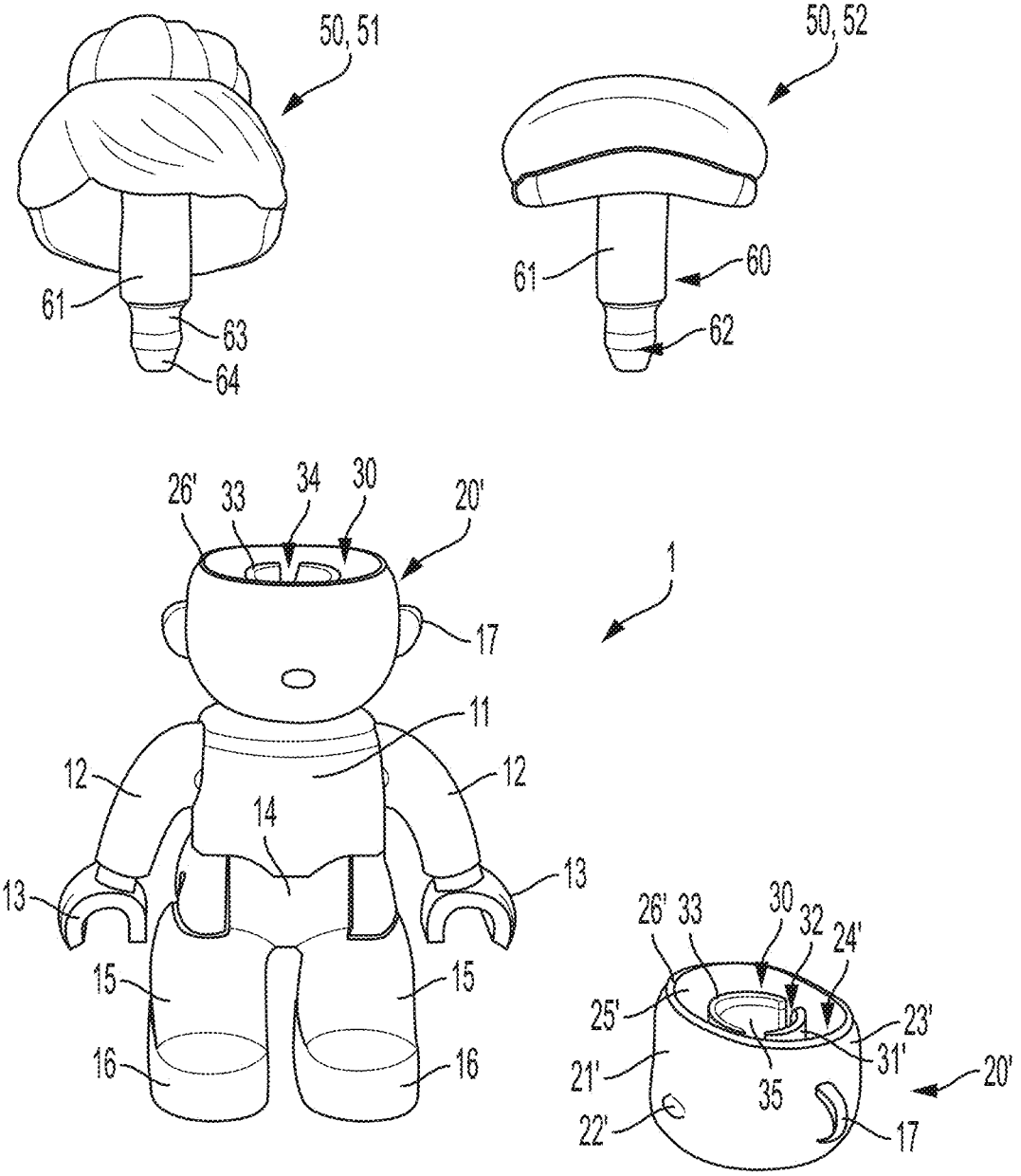
FIG. 1 shows a prior art toy figure with a toy figure head and various top headwear items, and a separate prior art toy figure head.

FIG. 1 shows a prior art toy figure system 1' comprising a toy FIG. 10 and two different top headwear items 50, in the form of a wig 51 and a cap or hat 52. The toy figure system 1' is a modular system, where the toy FIG. 10 comprises a toy figure body 11 and a toy figure head 20'. The toy figure body 11 may be provided with a releasably mounted toy figure head 20'. Thereby, the toy figure body 11 may be equipped with interchangeable heads, for example heads having different facial expressions or other characteristics, such as gender characteristics, etc. Also, the toy figure head 20' of the toy figure system 1' is shaped, so that it can be interchangeably be equipped with various different types of top headwear items 50, such as hair-type top headwear items (wigs), or hat-type top headwear items such as the hat 52 shown in FIG. 1.

The toy figure body 11 comprises two arms 12 rotationally connected thereto. A hand 13 is rotationally connected to each arm 12. A leg connector part 14 is rotationally connected to the toy figure body 11. Two legs are rotationally connected to the leg connector part 14. The legs 15 may be individually rotatable relative to the leg connector part 14, or they may be arranged to rotate in unison. Each leg 15 comprises a foot 16, which may be formed integral with the leg 15. The foot 16 may comprise a knob receiving indentation in a lower surface thereof, the knob receiving indentation being configured for cooperating with knobs of toy building blocks with cooperating knobs and indentations, such as it is known in the art of modular toy construction sets.

As mentioned, the toy FIG. 10 of the prior art toy figure system 1' as shown in FIG. 1 further comprises a prior art toy figure head 20'. The prior art toy figure head 20' comprises a front face 21' formed with a nose 22' and ears 17 formed on sides of a back skull portion 23'. The prior art toy figure head 20' comprises an inner space 24', and an upper opening 25' into the inner space 24'. The upper opening 25' defines a rim 26'. Inside the toy figure head 20', i.e. in the inner space 24', a first central coupling member 30 is formed.

The first central coupling member 30 formed as a tubular structure, such as cylindrical structure, having a tubular wall 31, with a first or upper end 31' and a second or lower end (not shown) connecting to a (not shown) bottom wall of the toy figure head 20'. Slits 32 may be formed in the tubular wall 31 of the first central coupling member 30 to provide a certain resilience of the first central coupling member 30 in order to receive a second central coupling member 60, see below. The slits 32 preferably extend in a longitudinal direction in the tubular wall 31 from the first end 31' thereof. The slits 32 extend only in an upper portion of the tubular wall 31, and thereby divide the upper end of the tubular wall into tongues 37. The upper end 31' of the first central coupling member 30 comprises an upper rim 33 encircling an opening 34 into an internal space 35 extending through the first central coupling member 30. As shown in FIG. 1, the internal space 35 is cylindrical.

FIG. 1 also shows a loose prior art toy figure head 20', i.e. a prior art toy figure head 20', which is not connected to a toy figure body 11.

As mentioned above, FIG. 1 shows two different types of top headwear items 50, a wig or hair like top headwear item 51, seen on the left of the figure, and a cap or hat type top headwear item 52.

Common to both of the shown types of top headwear items 50 is that they are provided with a downwardly extending second central coupling member 60. The second central coupling member 60 extends from an inner surface of the top headwear item 50.

A length of the first central coupling member 30 is configured such that the upper rim 33 of the tubular wall 31 abuts the inner surface of the top headwear item 50.

The second central coupling member 60 is formed as an elongate structure, such as peg 61, and having an upper end 61' connecting to the top headwear items 50 as such, and a lower end 61".

The second central coupling member 60 may be formed as a tubular structure, such as a generally cylindrical structure, having a tubular wall (not shown). However in other embodiments, the peg 61 is a solid elongate structure.

At the lower, end 61" of the peg 61, the second central coupling member 60 is provided with a second snap member 62 formed integrally with the peg 61 and in extension thereof, and comprising an indentation 63 and a bead 64.

The cross sectional shape of the peg 61 is shaped and dimensioned to fit snugly into the internal space 35 of the first central coupling member 30. In this case, the peg 61 is of cylindrical shape, therefore having a circular cross section with a diameter. The diameter of the peg 61 is preferably to fit snugly with a diameter of the cylindrical internal space 35 of the first central coupling member.

The second snap member 62 is configured to cooperate with a first snap member (not shown) being provided inside the toy figure body 11 of the toy FIG. 10. The length of the second central coupling member 60 is adapted such that it may extend through the internal space 35 of the first central coupling member 30 and reach the first snap means in the toy figure body 11. The first snap means are configured to releasably interlock with the second snap means 62 in a snap fit. Thereby, a top headwear item 50 may be joined to the toy FIG. 10 by placing a toy figure head 20' on the toy figure body 11, and extending the second central coupling member 60 thereof, through the internal space 35 of the first central coupling member 30 formed inside the toy figure head 20', and snapping the second snap member 62 into the first snap member (not shown) inside the toy figure body 11.

Figure 2:
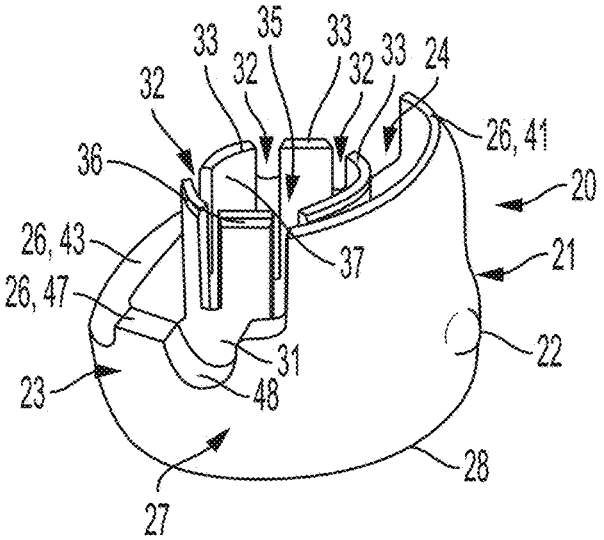
FIG. 2, in a perspective view, shows a toy figure head according to an embodiment of the disclosure.

Now turning to FIG. 2 showing an embodiment of a toy figure head 20 according to an aspect of the disclosure and for a toy figure system 1 according to another aspect of the disclosure.

The toy figure head 20 comprises a front face 21. The front face 21 may be formed with a nose 22. In not shown embodiments, other facial characteristics of a human face may be provided on the front face 21. The toy figure head 20 further comprises a back skull portion 23 and side skull portions 27.

The toy figure head 20 comprises an inner space 24, and an upper opening 25 into the inner space 24. The upper opening 25 defines a rim 26. Contrary to the rim 26' of the prior art toy figure head 20' described above, the rim 26 of the toy figure head 20 according to the disclosure is not defined in the same (horizontal) plane, but comprises rim sections, front face rim 41, a back scull rim 43 and side wall rims 47. These rim sections are arranged in horizontal planes in different heights over a lower rim 28 (see FIG. 3A) of the toy figure head 20.

Inside the toy figure head 20 shown in FIGS. 2 and 3, i.e. in the inner space 24, a first central coupling member 30 is formed.

Figure 3A:
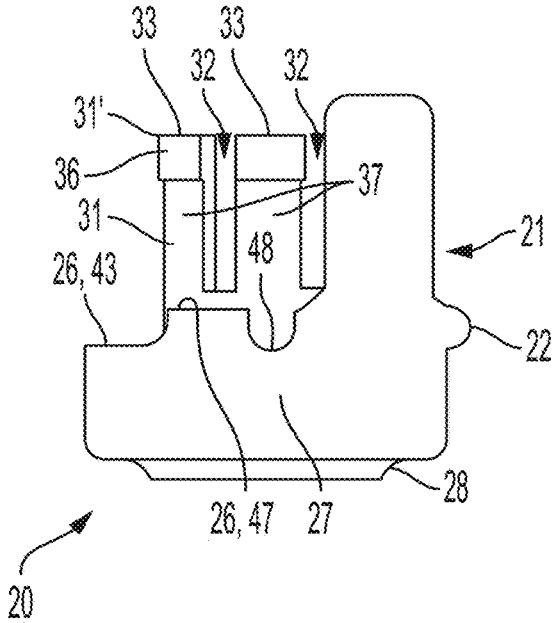
FIG. 3A shows a side view of a toy figure head according to an embodiment of the disclosure.
Figure 3B:
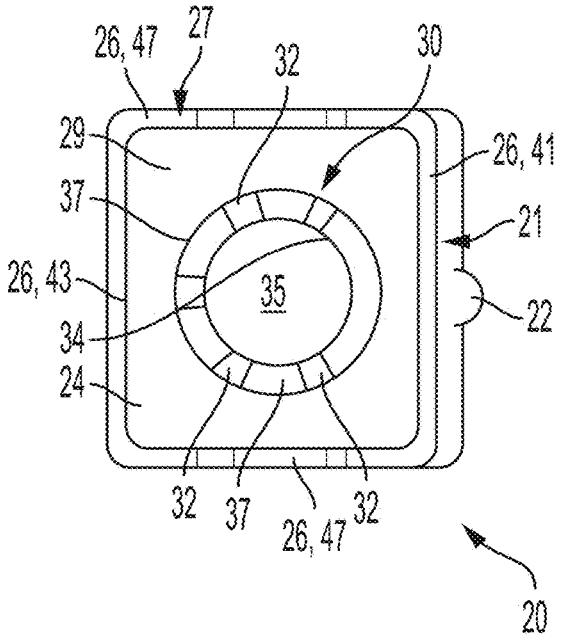
FIG. 3B shows a top view of the toy figure head in FIG. 3A.

The first central coupling member 30 formed as a tubular structure, such as cylindrical structure, having a tubular wall 31, with a first or upper end 31' and a second or lower end (not shown) connecting to a bottom wall 29 (See FIG. 3B) of the toy figure head 20. Slits 32 may be formed in the tubular wall 31 of the first central coupling member 30 to provide a certain resilience of the first central coupling member 30 in order to receive a second central coupling member 60 of a top headwear item 50, for example as described above. The slits 32 preferably extend in a longitudinal direction in the tubular wall 31 from the first/upper end 31' thereof. The slits 32 extend only in an upper portion of the tubular wall 31, and thereby divide the upper end of the tubular wall into tongues 37. The upper end 31' of the first central coupling member 30 comprises an upper rim 33 encircling an opening 34 into an internal space 35 of the first central coupling member 30. The internal space may extend through the first central coupling member 30. The internal space may further extend through the first central coupling member 30 and though the bottom wall 29 of the toy figure head 20. As shown in FIGS. 2 and 3, preferably the internal space 35 is cylindrical.

Figure 5A:
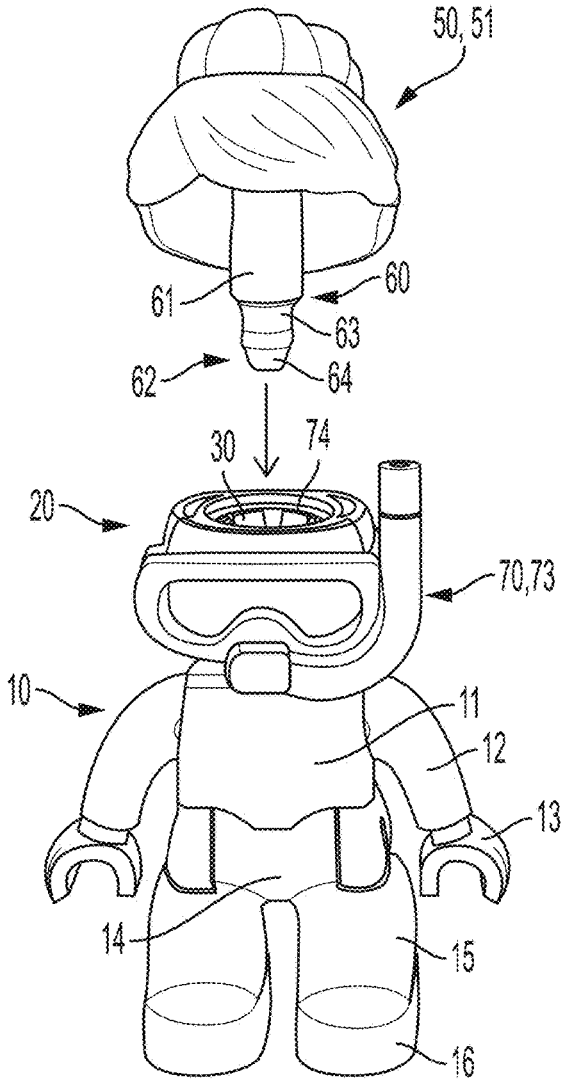
FIG. 5A shows a toy figure, with a toy figure head equipped with an intermediate headwear item, and a top headwear ready for mounting.

The toy figure head 20 according to the disclosure may form part of a toy figure system 1, such as a toy figure system shown in FIG. 5A.

Like the above described prior art toy figure system 1', the toy figure system according the disclosure comprises a toy figure head 20 according to the disclosure.

In embodiments, the toy figure system 1 according the disclosure may further comprise a toy FIG. 10. The toy FIG. 10 according to the toy figure system 1 of the disclosure may in general be similar to the toy figure described in connection with FIG. 1 above. However, as is described below it may also vary in some aspects.

In embodiments the toy figure system 1 according the disclosure may alternatively or additionally comprise at least one top headwear item 50. The top headwear item 50 according to the toy figure system 1 of the disclosure may in general be similar to the top headwear item 50 described in connection with FIG. 1 above. However, as is described below it may also vary in some aspects.

In embodiments the toy figure system 1 according the disclosure may alternatively or additionally comprise at least one intermediary headwear item 70. The intermediary headwear item 70 according to the disclosure is described in further detail below.

As with the prior art, the toy figure system 1 according to the disclosure is a modular system, where the toy FIG. 10 and a toy figure head 20 may be releasably connected to the toy FIG. 10. Thereby, the toy figure body 11 may be equipped with interchangeable heads, for example heads having different facial expressions or other characteristics, such as gender characteristics, etc. In other embodiments the head according to the disclosure may form part of toy FIG. 10, where the two are not intended for disassembly by the user.

However, in any case, the toy figure head 20 of the toy figure system 1 according to the disclosure is shaped, so that it can be interchangeably be equipped with various different types of top headwear items 50, such as hair-type top headwear items (wigs) 51, or hat-type top headwear items such as the hat 52 shown in FIG. 5A. Further, the toy figure head 20 of the toy figure system 1 according to the disclosure is shaped, so that it can interchangeably be equipped with various different types of intermediary headwear items 70, as will be described below.

As is the case with the prior art toy figure system 1', the toy FIG. 10 of the present toy figure system 1 comprises a toy figure body 11, The toy figure body 11 comprises two arms 12 rotationally connected thereto. A hand 13 is rotationally connected to each arm 12. A leg connector part 14 is rotationally connected to the toy figure body 11. Two legs are rotationally connected to the leg connector part. The legs 15 may be individually rotatable relative to the leg connector part 14, or they may be arranged to rotate in unison. Each leg 15 comprises a foot 16, which may be formed integral with the leg 15. The foot 16 may comprise a knob receiving indentation in a lower surface thereof, the knob receiving indentation being configured for cooperating with knobs of toy building blocks with cooperating knobs and indentations, such as it is known in the art of modular toy construction sets.

As mentioned above, FIG. 5A shows to different types of top headwear items 50, a wig or hair like top headwear item 51, seen on the left of the figure, and a cap or hat type top headwear item 52, seen on the right of the figure. The top headwear items 50 according to the present disclosure may be similar to the prior art top headwear items 50 described above.

Common to different types of top headwear items 50 according to the disclosure is that they are provided with a downwardly extending second central coupling member 60. The second central coupling member 60 extends from an inner surface of the top headwear item 50.

A length of the first central coupling member 30 is configured such that the upper rim 33 of the tubular wall 31 abuts the inner surface of the top headwear item 50.

The second central coupling member 60 is formed as an elongate structure, such as peg 61, and having an upper end 61' connecting to the top headwear items 50 as such, and a lower end 61". The second central coupling member 60 may be formed as a tubular structure, such as a generally cylindrical structure, having a tubular wall (not shown). However in other embodiments, the peg 61 is a solid elongate structure.

At the lower, end 61" of the peg 61, the second central coupling member 60 is provided with a second snap member 62 formed integrally with the peg 61 and in extension thereof. The second snap member 62 may comprise an indentation 63 and a bead 64. In other not shown embodiments, the second snap member 62 may be provided with other types of snap means.

The cross sectional shape of the peg 61 is shaped and dimensioned to fit snugly into the internal space 35 of the first central coupling member 30. In this case, the peg 61 is of cylindrical shape, therefore having a circular cross section with a diameter. The diameter of the peg 61 is preferably to fit snugly with a diameter of the cylindrical internal space 35 of the first central coupling member 30.

The second snap member 62 may in some embodiments, and as indicated in FIG. 5A be configured to cooperate with a first snap member (not shown) being provided inside the toy figure body 11 of the toy FIG. 10. The length of the second central coupling member 60 is adapted such that it may extend through the internal space 35 of the first central coupling member 30 and reach the first snap means in the toy figure body 11. The first snap means are configured to releasably interlock with the second snap means 62 in a snap fit. Thereby, a top headwear item 50 may be joined to the toy FIG. 10 by placing a toy figure head 20 on the toy figure body 11, and extending the second central coupling member 60 thereof, through the internal space 35 of the first central coupling member 30 formed inside the toy figure head 20, and snapping the second snap member 62 into the (not shown) first snap member inside the toy figure body 11.

In other (not shown) embodiments second snap member 62 may be configured to cooperate with a first snap member (not shown) being provided inside the toy figure head 20. The length of the second central coupling member 60 is adapted such that it may extend into the internal space 35 of the first central coupling member 30 and reach the first snap means formed therein. The first snap means are configured to releasably interlock with the second snap means 62 in a snap fit. In this case, preferably the toy figure head may be connected to the toy figure body through other (not shown) means, provided between the lower rim 28 of the toy figure head 20.

Now returning to FIGS. 2 and 3, the rim 26 of the toy figure head 20 comprises rim sections 41, 43, and 47. A first rim section, front face rim 41 is defined at an upper edge of the front face 21 of the toy figure head 20. A second rim section, a back scull rim 43, is defined at an upper edge of the back scull wall 23. Two third rim sections, side wall rims 47 are defined at upper edges of the two side walls 27 interconnecting the front face 21 and the back scull wall 23.

The front face rim 41 is arranged in a horizontal plane at a first height over a lower rim 28 (see FIG. 3A) of the toy figure head 20. The first height is preferably such that the front face rim 41 is level with or preferably slightly above the upper rim 33 of the first central coupling member 30 as shown in FIGS. 2 and 3A. The front face rim 41 is configured for abutting and supporting the above mentioned inner surface of the top headwear item 50.

The back scull rim 43 is arranged in a horizontal plane at a second height over the lower rim 28 (see FIG. 3A) of the toy figure head 20. Relative to vertical, the second height is preferably such that the back scull rim 43 is arranged much lower than the front face rim 41. The back scull rim 43 is configured for abutting and supporting a back portion of an intermediary headwear item 70.

The two side wall rims 47 are arranged in a horizontal plane at a third height over the lower rim 28 (see FIG. 3A) of the toy figure head 20. Relative to vertical, the third height is preferably such that the side wall rims 47 are arranged lower than the front face rim 41 but higher than the back scull rim 43. The side wall rims 47 are configured for abutting and supporting a side portion of an intermediary headwear item 70.

A notch 48 in the form of an indentation may preferably be defined in each of the two side wall rims 47. The notches 48 are configured for cooperating with matching taps formed on side portions of the intermediary headwear item 70.

Figure 4:
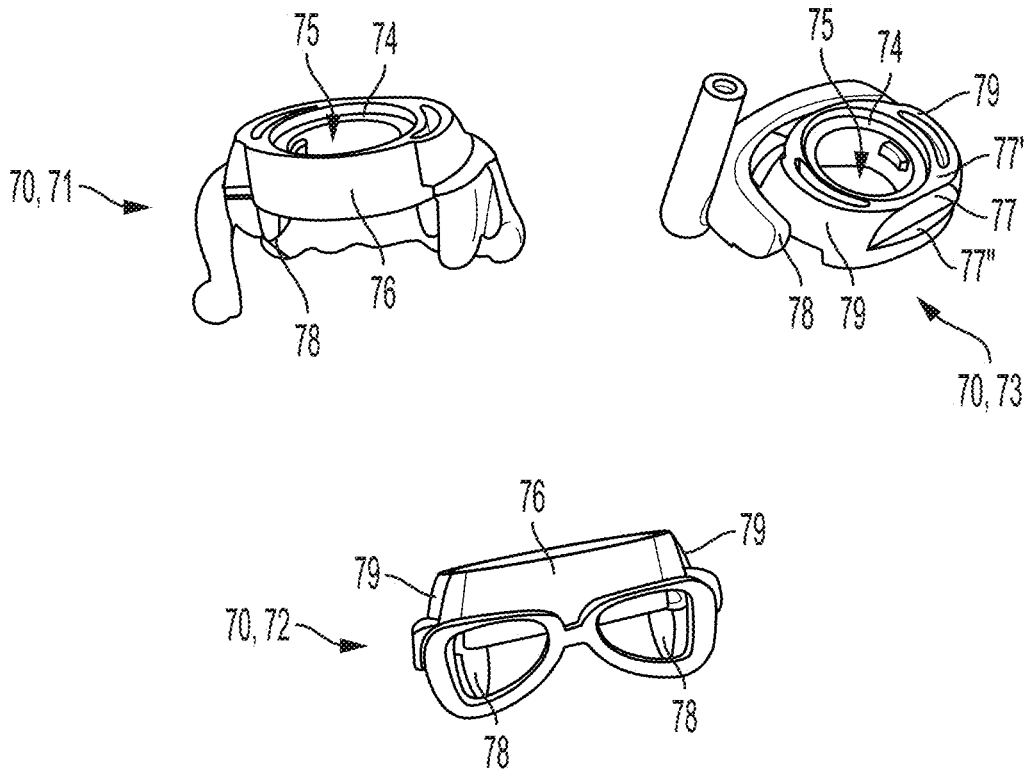
FIG. 4 shows various intermediary headwear items according to the disclosure

Now turning to FIG. 4 variants of an intermediary headwear item 70 according to the disclosure is described. The intermediary headwear item 70 is configured to be mounted on a toy figure head 20 in between the toy figure head 20 and a top headwear item 50.

In FIG. 4 three different variants of the intermediary headwear item 70 is show. It will be apparent to a person skilled in the art, that numerous other types of intermediary headwear items 70 are possible.

The intermediary headwear item 70 in the upper left hand corner of FIG. 4 shows a new wig type intermediary headwear item 71. It is apparent that such a wig 71 may be mounted between the toy figure head 20 and, for example, a hat 52 as shown in e.g. FIG. 1.

Figure 5B:
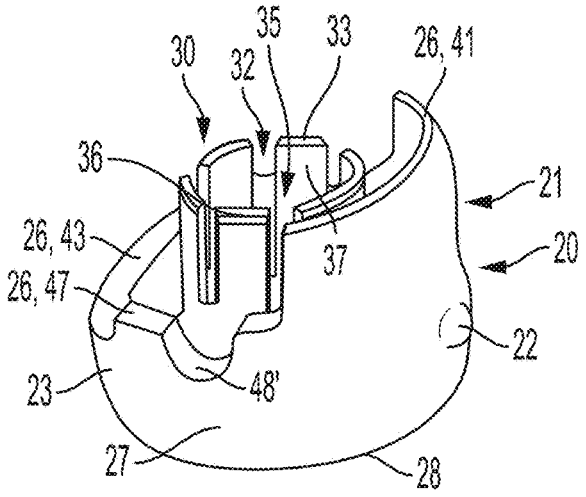
FIG. 5B, in a perspective view, shows a toy figure head for comparison with the mounted intermediary headwear item in FIG. 5A.

In the lower left hand corner of FIG. 4, an intermediary headwear item 70 in the form of a pair of glasses 72 is shown. It is apparent that such a pair of glasses 72 may be mounted between the toy figure head 20, and for example a hat 52, as shown in FIG. 1, or a wig 51 as shown in e.g. FIGS. 1 and 5 A.

On the upper right hand side of FIG. 4, an intermediary headwear item 70 in the form of a set of goggles with a snorkel is shown. Thereby a user such as a child, may change a toy FIG. 10 into a diver. As shown in FIG. 5A, the intermediary headwear item may for example be combined with a wig 51 of the users choosing.

As is apparent from the figures, numerous other intermediary headwear item 70 may be applied. For example a gas mask or beard. An eye patch may be indicative of a pirate and so on.

Despite the numerous options for providing different intermediary headwear items 70, they share the common trait of having coupling means which a complementary to the toy figure head 20 described above.

For the purpose of connecting the intermediary headwear item 70 to a toy figure head 20, the intermediary headwear item comprises a connector ring 74. The connector ring 74 comprises a through-going hole 75. The size and shape of the through going hole 75 through the connector ring 74 is configured for cooperating with the first central coupling member 30. Preferably, the tubular wall 31 of the first central coupling member 30 is cylindrical having an outer diameter, and the through going hole 75 through the connector ring 74 has a circular cross section with a diameter substantially equal to the outer diameter of the tubular wall 31.

A bead 36 may be formed along the rim 33 at the first or upper end 31' of the tubular wall 31 of the first central coupling member 31. Together with the resilience provided by the slits 32 in the tubular wall 31 they may provide a snap fit with the connector ring 74, when mounting the intermediary headwear item 70. The bead 36 bulges radially outward from an outer surface of the tubular wall 31, and preferably extend along the entire upper rim 33 thereof. It is apparent however, that the bead 36 is divided into sections by the slits 32.

The connector ring 74 may comprise a front portion 76 which may be configured for abutment against a rear side of the front face 21 of the toy figure head 70.

The connector ring 74 may preferably comprise a back portion 77. The back portion 77 comprises an upwardly facing surface 77' and a downwardly facing surface 77". The downwardly facing surface 77" is sized and shaped such that it will fit the upwardly facing back scull rim 43 of a toy figure head 20 as described above, when the intermediary headwear item 70 is mounted on the toy figure head 20. The upwardly facing surface 77' of the back portion 77 of the connector ring 74 is preferably sized and shaped to support an inner surface of a top headwear item 50.

The back portion 77 is preferably sized and shaped such that an outer surface thereof is flush with an outer surface of back scull portion 23 of the toy figure head 20, when the intermediary head wear item 70 is mounted to the toy figure head 20.

In further embodiments, each of two side portions 79 interconnecting the front portion 76 and the back portion 77 of the connector ring 74 may be provided with downwardly extending protrusions 78, sized and shaped to complement the notches 48 formed as indentations in the side rims 47 of the side walls 27 of the toy figure head 20. Further, the side portions 79 of the connector ring 74 are shaped and sized such that an outer surface thereof is flush with an outer surface of the side walls 27 of the toy figure head 20, when the intermediary head wear item 70 is mounted to the toy figure head 20.

Mounting the intermediary headwear item 70 of the outside of the first central coupling member 30 allows a top headwear item 50 to be mounted to the toy figure head 20 in a manner similar to described for the prior art toy figure system 1' described above. Once the intermediary headwear item 70 has been mounted on the toy figure head 20 by placing the hole 75 of the connector ring 74 over the first central coupling member 30 of the toy figure head 20 and pressing it over the first central coupling member 30, the second central coupling member 60 of the top headwear item 50 may be slid into the inside space of the first central coupling member 30, such that the second snap member 62 is snapped into the complementary first snap member (not shown) provided either in the toy figure body 11 or in the toy figure head 20, as described above.

It is apparent that a top headwear item 50 may also be mounted on the toy figure head when no intermediary headwear item is connected to the toy figure head 20.

The parts of the toy FIG. 10 may each be formed in an injection moulding process and be formed in a material such as a plastic.

The toy figure head 20 may be formed in an injection moulding process and be formed in a material such as a plastic.

The top headwear items 50 may be formed in an injection moulding process and be formed in a material such as a plastic.

The intermediary headwear items 70 may be formed in an injection moulding process and be formed in a material such as a plastic.

It is to be noted that the figures and the above description have shown the example embodiments in a simple and schematic manner. Many of the specific mechanical details have not been shown since the person skilled in the art should be familiar with these details and they would just unnecessarily complicate this description. For example, the specific materials used and the specific injection moulding procedure have not been described in detail since it is maintained that the person skilled in the art would be able to find suitable materials and suitable processes to manufacture the toy figure head and the intermediary headwear item and the toy figure system according to the current disclosure.

PARTS LIST

1 toy figure system
1' prior art toy figure system
10 toy FIG.
11 toy figure body
12 arm
13 hand
14 leg connector part
15 leg
16 foot
17 ear
20 toy figure head
20' prior art toy figure head
21 front face
21' prior art front face
22 nose
22' prior art nose
23 back scull portion
23' prior back scull portion
24 inner space of toy figure head
24' inner space of prior art toy figure head
25 upper opening into the inner space of the toy figure head
25' upper opening into the inner space of the prior art toy figure head
26 rim encircling the upper opening into the inner space of the toy figure head
26' rim encircling the upper opening into the inner space of the prior art toy figure head
27 side wall of toy figure head
28 lower rim of toy figure head
29 bottom wall of toy figure head

30 first central coupling member
31 tubular wall of the first central coupling member
31' first or upper end of the tubular wall of the first central coupling member
32 slits formed in the tubular wall
33 upper rim of the tubular wall of the first central coupling member
34 opening into an internal space of the first central coupling member
35 internal space of the first central coupling member
36 bead formed at first or upper end of the tubular wall of the first central coupling member
37 tongues
41 front face rim
43 back scull rim
47 side wall rim
48 notches formed as indentation in side wall rim
50 top headwear item
51 wig
52 hat
60 second central coupling member
61 peg of the second central coupling member
61' upper end 61' of peg connecting to the top headwear items as such
61" lower end
62 second snap member at the lower end of the peg
63 indentation formed in the second snap member
65 bead formed in the second snap member
70 intermediary headwear item
71 intermediary headwear item in the form of wig
72 intermediary headwear item in the form of glasses
73 intermediary headwear item in the form of a goggles with a snorkel
74 connector ring
75 through-going hole through connector ring
76 front portion of connector ring
77 back portion of connector ring
77' upwardly facing surface of the back portion of the connector ring
77' downwardly facing surface of the back portion of the connector ring
78 downwardly extending protrusions on side portions of the connector rim, the protrusion being sized and shaped to complement the notches in the side wall rim of the toy figure head
79 side portion interconnecting the front portion and the back portion of the connector ring.

What is claimed is:

1. A toy figure system comprising:
a toy figure head, and
a top headwear item,
wherein the toy figure head comprises a first central coupling member, the first coupling member comprising a tubular wall with an internal space and an outer surface;
wherein the top headwear item comprises a second central coupling member configured for cooperating with said internal space of the first coupling member; and
wherein the toy figure system comprises an intermediate headwear item, comprising a connector ring configured for coupling to or encircling the outer surface of said first coupling member.

2. The toy figure system according to claim 1, wherein the second central coupling member comprises a second snap member and wherein the first central coupling member comprises a complementary first snap member.

3. The toy figure system according to claim 1, wherein the first coupling member comprises a bead formed along an upper rim of the tubular wall such that an intermediate headwear item may be connected to the first coupling member in a snap fit connection.

4. The toy figure system according to claim 1, wherein the toy figure head comprises a front face, a back scull portion and two side surfaces interconnecting the front face and the back scull portion,
wherein the front face comprises a front face rim,
wherein the back scull portion comprises a back scull rim, and
wherein the back scull rim is formed lower than the front face rim.

5. The toy figure system according to claim 4, wherein the intermediate headwear item comprises a back portion having an upwardly facing surface and a downwardly facing surface, where the downwardly facing surface is configured for abutment with the back scull rim of the toy figure head.

6. The toy figure system according to claim 5, wherein the upwardly facing surface of the back portion of the connector ring is sized and shaped to support an inner surface of a top headwear item.

7. The toy figure system according to claim 5, wherein the back portion is preferably sized and shaped such that an outer surface thereof is flush with an outer surface of back scull portion of the toy figure head, when the intermediary head wear item is mounted to the toy figure head.

8. The toy figure system according to claim 1, wherein the connector ring comprises a front portion configured for abutment against a rear side of the front face of the toy figure head.

9. The toy figure system according to claim 8, wherein each of two side portions interconnecting the front portion and the back portion of the connector ring is provided with downwardly extending protrusions, sized and shaped to complement notches formed as indentations in the side rims of the side walls of the toy figure head.

10. The toy figure system according to claim 9, wherein the side portions of the connector ring are shaped and sized such that an outer surface thereof is flush with an outer surface of the side walls of the toy figure head, when the intermediary head wear item is mounted to the toy figure head.

11. The toy figure system according to claim 1, wherein the tubular wall of the first central coupling member is cylindrical having an outer diameter, and wherein the connector ring comprises a through-going hole through the connector ring, having a circular cross section with a diameter substantially equal to the outer diameter of the tubular wall.

12. A toy figure system comprising:
a toy figure head including:
a front face having a front face rim,
a back scull portion having a back scull rim formed lower than the front face rim,
two side surfaces interconnecting the front face and the back scull portion, and
a first central coupling member, the first coupling member comprising a tubular wall with an internal space and an outer surface;
a top headwear item including a second central coupling member configured for cooperating with said internal space of the first coupling member; and
an intermediate headwear item including a connector ring configured for coupling to or encircling the outer surface of said first coupling member, the intermediate headwear item also including a back portion having an upwardly facing surface and a downwardly facing surface, the downwardly facing surface configured for abutment with the back scull rim of the toy figure head.

13. A toy figure system comprising:

a toy figure head including a first central coupling member, the first coupling member comprising a tubular wall with an internal space and an outer surface;

a top headwear item including a second central coupling member configured for cooperating with said internal space of the first coupling member; and an intermediate headwear item including a connector ring configured for coupling to or encircling the outer surface of said first coupling member, the connector ring having:

a front portion configured for abutment against a rear side of the front face of the toy figure head, and two side portions interconnecting the front portion and a back portion of the connector ring, the side portions provided with downwardly extending protrusions sized and shaped to complement the notches formed as indentations in side rims of the side walls of the toy figure head.

* * * * *